US008567529B2

(12) United States Patent
Williams

(10) Patent No.: US 8,567,529 B2
(45) Date of Patent: Oct. 29, 2013

(54) PERMANENT MAGNET DIRECT DRIVE TOP DRIVE

(75) Inventor: Kevin R. Williams, Cypress, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 239 days.

(21) Appl. No.: 13/126,319

(22) PCT Filed: Mar. 16, 2009

(86) PCT No.: PCT/US2009/037302

§ 371 (c)(1),
(2), (4) Date: May 31, 2011

(87) PCT Pub. No.: WO2010/056385

PCT Pub. Date: May 20, 2010

(65) Prior Publication Data

US 2011/0253455 A1 Oct. 20, 2011

Related U.S. Application Data

(60) Provisional application No. 61/114,930, filed on Nov. 14, 2008.

(51) Int. Cl.
*E21B 23/00* (2006.01)

(52) U.S. Cl.
USPC ..... 175/103; 175/203

(58) Field of Classification Search
USPC ..... 175/92, 103, 203
See application file for complete search history.

(56) References Cited

U.S. PATENT DOCUMENTS

| | | | |
|---|---|---|---|
| 2,709,284 | A | 5/1955 | Evans et al. |
| 3,211,803 | A | 10/1965 | Pryor et al. |
| 3,231,803 | A | 1/1966 | Pryor et al. |
| 3,653,636 | A | 4/1972 | Burrell |
| 4,046,355 | A | 9/1977 | Martin |
| 4,226,311 | A | 10/1980 | Johnson et al. |
| 4,242,057 | A | 12/1980 | Bender |
| 4,284,253 | A | 8/1981 | Uribe |

(Continued)

FOREIGN PATENT DOCUMENTS

| | | | |
|---|---|---|---|
| WO | 8908941 | A1 | 9/1989 |
| WO | 00/76054 | A1 | 12/2000 |
| WO | 2005021927 | A1 | 3/2005 |

OTHER PUBLICATIONS

Office Action for U.S. Appl. No. 12/876,673, mailed on Apr. 5, 2013 (12 pages).

(Continued)

*Primary Examiner* — William P Neuder
(74) *Attorney, Agent, or Firm* — Adolph Locklar

(57) ABSTRACT

A drive system (40) for a drilling has a housing (42) with an interior chamber (60), a stator (62) positioned within the interior chamber (60), a rotor (64) positioned in interior of the stator (62) and within in the interior chamber (60) of the housing (42), and a drive plate (66) affixed to the rotor (64). The rotor (64) has a plurality of permanent magnets in spaced relation around a periphery of the rotor. The stator (62) has a plurality of windings extending in spaced relation around an interior diameter of the stator so as to as be cooperative with the plurality of permanent magnets. The drive plate (66) has an interior passageway suitable for joining to a stem of the drill string.

18 Claims, 5 Drawing Sheets

(56) References Cited

U.S. PATENT DOCUMENTS

| | | | | |
|---|---|---|---|---|
| 4,314,692 | A | 2/1982 | Brauer et al. | |
| 4,438,904 | A | 3/1984 | White | |
| 4,527,959 | A | 7/1985 | Whiteman | |
| 4,545,017 | A | 10/1985 | Richardson | |
| 4,545,567 | A | 10/1985 | Telford et al. | |
| 4,910,790 | A | 3/1990 | Kershaw | |
| 5,146,433 | A | 9/1992 | Kosmala et al. | |
| 5,259,731 | A | 11/1993 | Dhindsa et al. | |
| 5,306,124 | A | 4/1994 | Back | |
| 5,331,238 | A | 7/1994 | Johnsen | |
| 5,351,767 | A * | 10/1994 | Stogner et al. | 175/162 |
| 5,375,098 | A | 12/1994 | Malone et al. | |
| 5,616,009 | A | 4/1997 | Birdwell | |
| 5,952,757 | A | 9/1999 | Boyd | |
| 6,029,951 | A | 2/2000 | Guggari | |
| 6,094,024 | A | 7/2000 | Westlake | |
| 6,182,945 | B1 | 2/2001 | Dyer et al. | |
| 6,419,465 | B1 | 7/2002 | Goettel et al. | |
| 6,577,483 | B1 | 6/2003 | Steicher et al. | |
| 6,995,682 | B1 | 2/2006 | Chen et al. | |
| 7,462,138 | B2 | 12/2008 | Shetty et al. | |
| 7,549,467 | B2 * | 6/2009 | McDonald et al. | 166/66.4 |
| 7,633,248 | B1 | 12/2009 | Williams | |
| 7,737,592 | B2 | 6/2010 | Makino et al. | |
| 7,851,962 | B1 * | 12/2010 | Williams | 310/212 |
| 2002/0121823 | A1 | 9/2002 | Gauthier | |
| 2004/0256110 | A1 | 12/2004 | York et al. | |
| 2005/0206266 | A1 | 9/2005 | Hans | |
| 2006/0017339 | A1 | 1/2006 | Chordia et al. | |
| 2006/0049712 | A1 | 3/2006 | Zepp et al. | |
| 2006/0108881 | A1 | 5/2006 | Hauger et al. | |
| 2006/0108890 | A1 | 5/2006 | Hauger et al. | |
| 2006/0133905 | A1 | 6/2006 | Woodruff | |
| 2006/0175064 | A1 | 8/2006 | Yuratich | |
| 2006/0181238 | A1 | 8/2006 | Choi et al. | |
| 2007/0053780 | A1 | 3/2007 | Ruffner et al. | |
| 2007/0114856 | A1 | 5/2007 | Park | |
| 2007/0228862 | A1 | 10/2007 | Welchko et al. | |
| 2007/0241627 | A1 | 10/2007 | Kharsa | |
| 2007/0261888 | A1 | 11/2007 | Urquhart | |
| 2007/0267222 | A1 * | 11/2007 | Howard et al. | 175/122 |
| 2008/0061645 | A1 | 3/2008 | Yukitake | |
| 2008/0116432 | A1 | 5/2008 | Folk et al. | |
| 2008/0181798 | A1 | 7/2008 | Folk et al. | |
| 2008/0203734 | A1 | 8/2008 | Grimes et al. | |
| 2008/0265813 | A1 | 10/2008 | Eschleman et al. | |
| 2008/0267785 | A1 | 10/2008 | Cervenka et al. | |
| 2011/0295269 | A1 | 12/2011 | Swensgard et al. | |
| 2011/0309315 | A1 * | 12/2011 | Williams | 254/362 |

OTHER PUBLICATIONS

Office Action for U.S. Appl. No. 12/876,673, mailed on Oct. 24, 2012 (16 pages).

Office Action for U.S. Appl. No. 12/643,439, mailed on Aug. 7, 2012 (21 pages).

Office Action for U.S. Appl. No. 12/643,439, mailed on Feb. 10, 2012 (20 pages).

Office Action for U.S. Appl. No. 12/629,354, mailed on Dec. 19, 2011 (11 pages).

Office Action for U.S. Appl. No. 12/629,354, mailed on Dec. 31, 2012 (11 pages).

Office Action for U.S. Appl. No. 12/629,354, mailed on Apr. 11, 2012 (11 pages).

* cited by examiner

PERMANENT MAGNET DIRECT DRIVE TOP DRIVE

FIELD OF THE INVENTION

The present invention relates to top drive drilling systems. More particularly, the present invention relates to permanent magnet systems for top drive system applications.

BACKGROUND OF THE INVENTION

Conventional rotatory drilling as practiced for many years has required the use of a rotary table containing an opening through which a non-circular kelly pipe extends for engagement with a kelly bushing mounted in the table, driving the kelly bushing and connected drill string rotatively while permitting downward advancement of the kelly relative to the table.

In recent years, an alternative drilling system has a drilling unit having a section of pipe connectable to the upper end of the drill string and a motor for driving the pipe rotatively to turn the string. The entire powered drilling assembly may then move upwardly and downwardly with the string to drive the string very directly and positively and without the necessity for a kelly and kelly bushing-type connection. This type of system is called a "top drive" drilling system.

In such a top drive drilling system, there is substituted for the usual rotary table, kelly, and related equipment, an assembly which is connected to the upper end of the drill string which moves upwardly and downwardly therewith and has a motor driving a rotary element or stem connected to the string and acting to turn it. The powered top drive assembly is usually guided in its upward and downward movement by tracks or guide elements fixed to the rig derrick or mast.

FIG. 1 illustrates a conventional prior art top drive drilling system. The top drive drilling rig 10 has the usual derrick 11 having a rig floor 12 containing an opening 13 through the which the drill string 14 extends downwardly into the earth 15 to drill a well 16. The drill string is formed of a series of pipe connections interconnected at threaded joint 17 and having a bit at the lower end of the string. At vertically spaced locations, the string has stabilizer portions which may include stabilizer elements 18 extending helically along the outer surface of the string to engage the wellbore wall in a manner centering the drill string therein.

The string is turned by a top drive drilling unit 19 which is connected to the upper end of the string and moves upwardly and downwardly therewith along the vertical axis 20 of the well. A pipe handler assembly 21 is suspended from the drilling unit. The drilling unit 19 has a swivel 22 at its upper end to which drilling fluid is introduced into the string, and by which the unit is suspended from a traveling block 23 which is suspended and moved upwardly and downwardly by a line 24 connected at its upper end to a crown block 25 and actuated by the usual drawworks 26. The drilling unit 19, pipe handler 21 and connected parts are guided for vertical movement along axis 20 by two vertical guide rails or tracks 27 rigidly attached to derrick 11. The drilling unit 19 is attached to a carriage 28 having rollers engaging and located by rails and guided by those rails for vertical movement upwardly and downwardly along the rails parallel to axis 20. The top drive drilling unit 19 includes a housing 30 which is connected to the carriage 28 in fixed position relative thereto during drilling and round tripping operations. A motor is positioned so as to suitably drive the drill string. Conventionally, this motor is an AC or DC motor which receives a power supply for the rotational capabilty. Typical transmission systems are integrated in association with the motor so as to provide the requisite torque for the rotation of the drill string. As such, the motor is actually indirectly interconnected to the drill string.

In the past, various patents have issued relating to such top drive systems. For example, U.S. Pat. No. 4,437,524, issued on Mar. 20, 1984 to Boyadjieff et al., shows a well drilling system that has a drilling unit with a tubular part connectible to the upper end of the drill string and a motor for driving that tubular part rotatively. The drilling unit is mounted by a guide structure for vertical movement.

U.S. Pat. No. 4,449,596 issued on May 22, 1984 to Boyadjieff, shows a well drilling apparatus having a top drive drilling assembly with a motor driven stem adapted to be attached to the upper end of a drill string. A torque wrench is carried by the top drive assembly and movable upwardly and downwardly therewith and operable so as to break a threaded connection between the drill string and the stem. An elevator is carried by and suspended from the top drive assembly and adapted to engage a section of drill pipe beneath the torque wrench in suspending relation.

U.S. Pat. No. 4,529,045, issued on Jul. 16, 1985 to Boyadjieff et al., teaches a top drive well drilling unit which is connected to the upper end of a drill string to drive it rotatively in drilling a well. The drilling unit is movable upwardly and downwardly with the string along a guide structure. A pipe handling mechanism is provided beneath the drilling unit for making and breaking a threaded connection between the drilling unit and the string. The pipe handling mechanism is retained against rotation with the drill string during a drilling operation, but is constructed to allow rotation of the elevator and a suspended string relative to the drilling unit when the string is supported by the elevator without connection to the drilling unit.

U.S. Pat. No. 4,605,077, issued on Aug. 12, 1986 to Boyadjieff, describes a top drive drilling system having a motor which is connected to the upper end of the drill string and moves upwardly and downwardly therewith. This top drive drilling system enables the drill string to be pulled upwardly off of the bottom of the well each time an additional length of drill pipe is added to the string. The connection between that added length and the upper end of the string is made at an elevated location spaced above the rig floor. An elevated platform is provided on which a person may move to a location near the raised upper end of the string for assisting in making the connection.

U.S. Pat. No. 7,055,594, issued on Jun. 6, 2006 to Springett et al., shows a top drive drilling system having a top drive unit and a pipe gripping system beneath the top drive unit. The pipe gripping system has an open throat for receiving a tubular to be gripped by the pipe gripping system. The gripping system has a body with first and second jaws movably connected thereto and piston/cylinder devices movably interconnected with each jaw for moving the jaws to clamp and then to rotate the pipe.

U.S. Pat. No. 7,188,686, issued on Mar. 13, 2007 to Folk et al., describes a top drive system for wellbore operations that includes a hollow bore alternating current permanent magnet motor with a motor bore therethrough. A planetary gear system is coupled to the motor. The gear system has a gear system bore therethrough. A quill is drivingly connected to the planetary gear system and rotatable thereby to rotate a tubular member located below the quill. The motor adjacent the gear system is aligned with the gear system bore so that fluid is flowable through the top drive system from the top of the motor to the bottom of the planetary gear system and into and through the quill.

U.S. Pat. No. 7,401,664, issued on Jul. 22, 2008 to Wells et al., describes a top drive system having a motor apparatus and a main shaft driven by the motor apparatus. The main shaft has a top end and a bottom end. A quill is connected to the main shaft. A gear system is interconnected with the quill and the motor apparatus.

U.S. Pat. No. 7,419,012, issued on Sep. 2, 2008 to Lynch, describes a drive system for wellbore operations having a main body, a motor apparatus, and a main shaft extending from the main body and rotatable by the motor. The main shaft has a top end and a bottom end. A structure is non-threadedly connected to the main shaft.

One of the problems with prior art top drive systems is the utilization of an indirectly interconnected motor and gearing system to the drill stem. The motor and the associated gear system are extremely heavy. In order to achieve the requisite torque, very large and complicated gearing systems are required. Unfortunately, because of the large size of the motor and gearing systems, the entire system cannot be easily transported on road systems. Typically, the motor and the associated gearing system must be transported as separate items along the roads and then assembled on site. The assembly process becomes very complicated and extreme precision is required so as to properly integrate the motor with the gearing system and with the drill string. In view of the relatively large nature of these systems, the AC motor that is associated with such systems has an extremely large rotor. As such, there are strong inertial effects whenever the motor is rotating. In other words, the large inertial effects can cause difficulty in breaking the operation of the motor. In typical use, one type of motor and associated gearing system are required for a top drive system, another motor and associated gear system is required for the drawworks, and still a further motor and gearing system is associated with the mud pumping mechanism. As such, a need has developed so as to provide a lower weight, greater power density motor that can be easily transported as a single unit on road systems.

It is an object of the present invention to provide a direct drive top drive motor that requires no gearing mechanism.

It is another object of the present invention to provide a direct drive top drive motor that has a very high power density.

It is still another object of the present invention to provide a direct drive top drive system which is relatively light weight.

It is still a further object of the present invention to provide a direct drive top drive system that can be easily transported on conventional road systems.

It is a further object of the present invention to provide a direct drive top drive system which requires no assembly or precision installation in the field.

It is still another object of the present invention to provide a direct drive top drive system that has reduced inertial effects.

It is still another object of the present invention to provide a direct drive top drive system that utilizes a motor that can be easily interchanged between use in association with the top drive, the mud pump and the drawworks.

These and other objects and advantages of the present invention will become apparent from a reading of the attached specification and appended claims.

BRIEF SUMMARY OF THE INVENTION

The present invention is a permanent magnet direct drive top drive. The direct drive top drive of the present invention includes a housing having a stator positioned within the housing and a rotor cooperative with the stator and located interior of the stator within the housing. The rotor is interconnectable to a drill stem so that rotational motion imparted by the permanent magnet motor can be directly imparted to the drill stem and, accordingly, to the connected drill string.

The housing of the present invention has an interior chamber surrounded by a wall. The housing has a passageway at the bottom so as to allow for the passage of the drill stem. A stator is positioned adjacent to the inner wall of the housing. The stator has a plurality of windings extending therearound. These windings are maintained in spaced relationship around the inner diameter of the stator. These windings extend radially inwardly from the inner wall of the housing. Suitable air flow passageways are provided throughout the stator so as to enhance the cooling effect of air exchange with the stator.

A rotor is positioned on the interior of the stator. This rotor is an annular member having a permanent magnets located in spaced relationship to each other around the periphery of the rotor. The permanent magnets are cooperative with the windings so as to provide the motor-effect of the permanent magnet motor. A drive plate is affixed to the rotor. This drive plate has a splined interior aperture so as to suitably engage the splines of the associated drill stem.

In the present invention, the drill stem is received by the drive plate of the rotor. As such, when rotational forces are imparted to the rotor, the rotational forces are directly imparted to the drill stem and the associated drill string. As such, the present invention is able to directly rotate the drill stem without the need for gearing mechanisms or transmission systems.

DETAILED DESCRIPTION OF THE INVENTION

Figure 1:
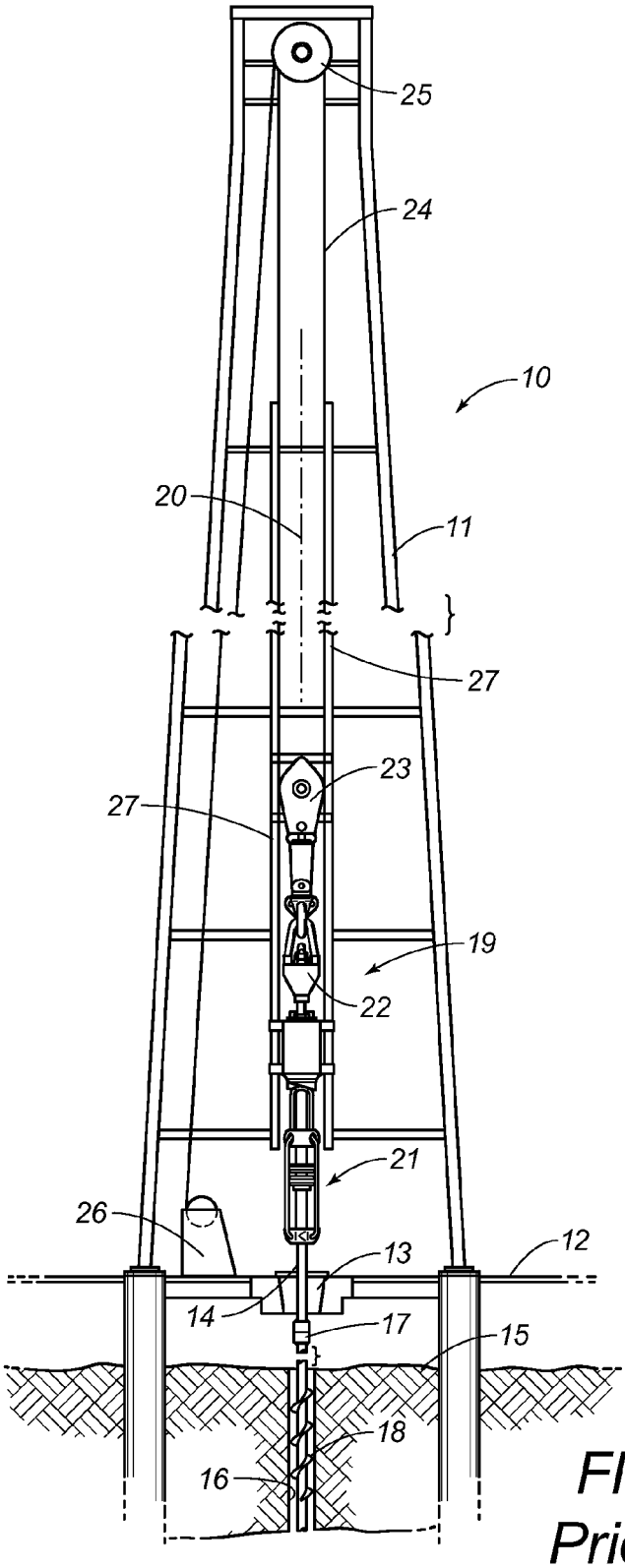
FIG. 1 Prior Art
FIG. 1 is a diagrammatic illustration of a direct drive top drive system.
Figure 2:
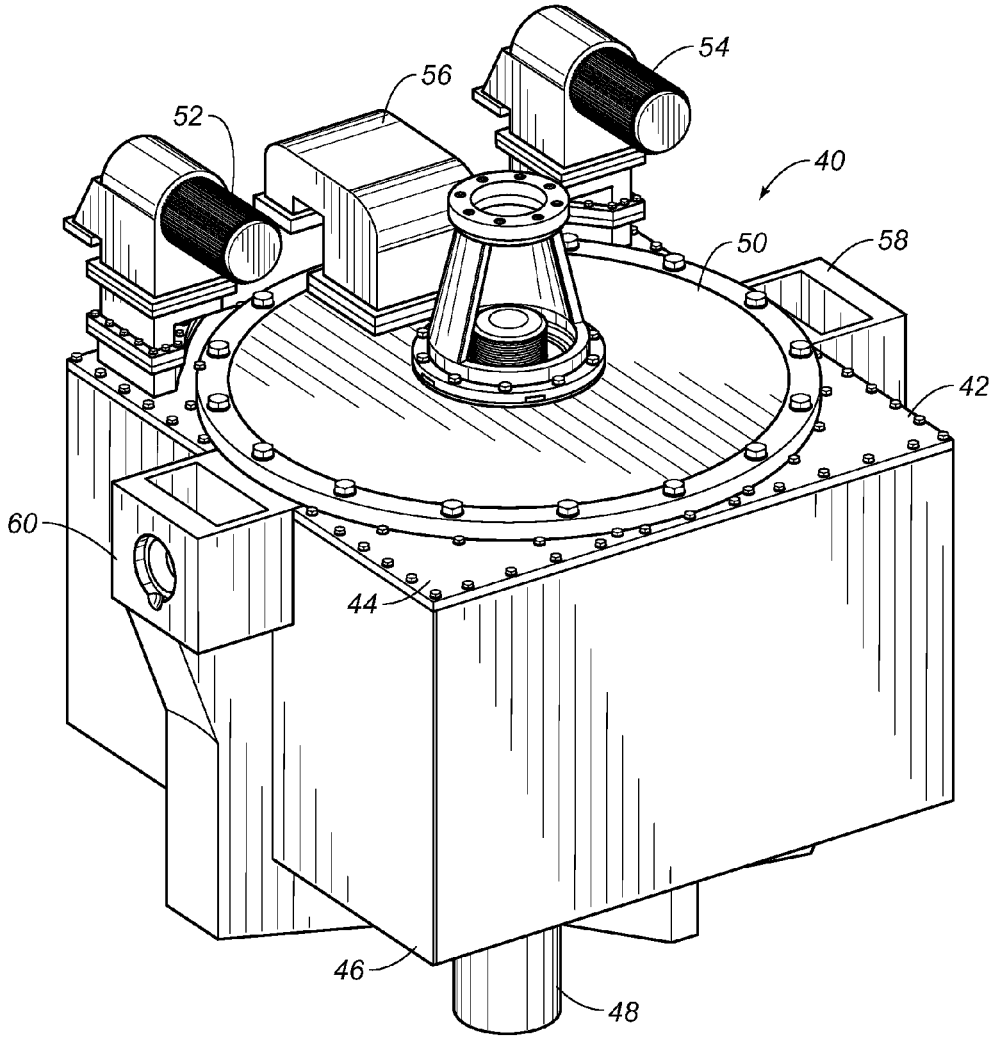
FIG. 2 is a perspective view showing the housing of the permanent magnet direct drive top drive of the present invention.

Referring to FIG. 2, there is shown at 40 the permanent magnet direct drive top drive in accordance with the teachings of the present invention. The permanent magnet direct drive top drive 40 is illustrated as having a housing 42 with the rotor and stator of the permanent magnet assembly located therein. The housing 42 is of a generally cubical nature having a top surface 44 and bottom surface 46. A collar 48 extends downwardly from the bottom surface 46. Collar 48 will serve to support the drill stem as extending outwardly of the interior of the permanent magnet direct drive top drive system 40. A cover 50 is affixed to the top surface 44 of the housing 42. The cover 50 is a circular cover having a plurality of bolt holes formed therein. As such, the cover 50 is bolted to the top surface 44. The cover 50 is illustrated as having a cooling air inlets 52 and 54 extending outwardly therefrom. The cooling air inlets 52 and 54 serve to deliver cooling air to the permanent magnets located on the interior of housing 42. A cooling air discharge port 56 is positioned between the cooling air inlets 52 and 54 and serves to allow for the discharge of heated air from the interior of the housing 42. The cooling air discharge port 56 is affixed to the cover 50 so as to communicate with the interior of the housing 42. It can be seen that suitable hanger assemblies 58 and 60 extend outwardly from opposite sides of the housing 42. Hanger assemblies 58 and 60 allow the direct drive top drive system 40 to be suitably interconnected to the drawworks of the drilling rig.

Figure 3:
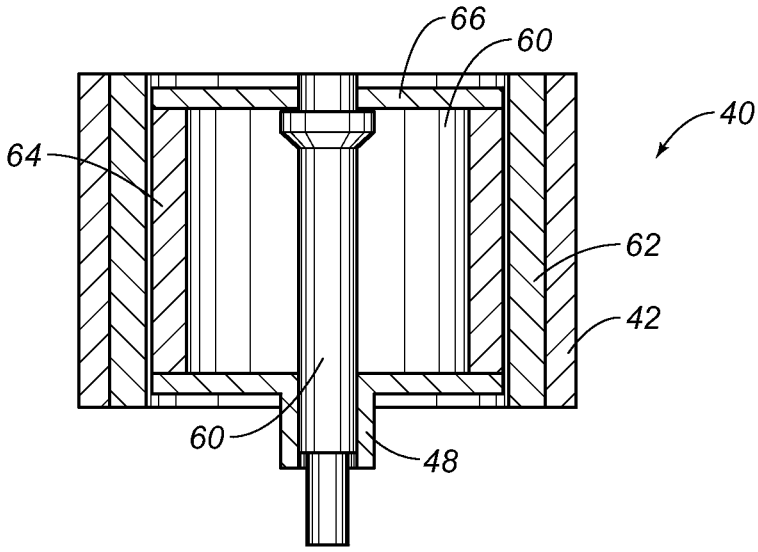
FIG. 3 is a cross-sectional view showing the permanent magnet direct drive top drive of the present invention.

FIG. 3 illustrates the interior of the permanent magnet direct drive top drive system 40. As can be seen, the housing 42 defines an interior chamber 60. The stator 62 is affixed to the wall of the housing 42 and extends around the circular interior of the housing 42. A rotor 64 is positioned in close proximity to stator 62. Rotor 64 will have a plurality of permanent magnets formed around the periphery thereof. The interaction of the coils of the stator 62 and the permanent magnets of the rotor 64 provide the rotational power for the permanent magnet direct drive top drive system 40. A drive plate 66 is affixed to the top of the rotor 64. It can be seen that the drill stem 68 is engaged with the drive plate 66 so that rotational energy imparted to the drive plate 66 will be imparted to the drill stem 68. The drill stem 68 extends outwardly through the collar 48 located at the bottom of housing 42.

Permanent magnet motors rotate because of the torque that the interaction of two magnet fields causes. These magnetic fields are created by the permanent magnets mounted on the rotating rotor and the magnetic field that the stationary windings of the stator induce. The torque is greatest when the magnetic vector of the rotor is at 90° to the magnetic vector of the stator. In this position, it forces the poles of the rotor to rotate in the direction of the stator field. In a trapezoidally-driven brushless-DC motor, a current flow alternating sequentially through two of the three coils generates the stator field. The remaining third coil monitors the back EMF (electromotive force) of the two active coils. Back EMF occurs when a permanent magnet motor rotates. Each winding generates a voltage that opposes the main voltage of the windings. Back EMF depends on the angular velocity of the rotor, the magnetic field that the rotor magnets generate, and the number of turns in the stator windings. The motor's back EMF provides the feedback of the rotor's position with respect to the stator windings. Permanent magnet motors having sensors provide a similar position feedback. With sinusoidal commutation, which permanent magnet synchronous motor use, the drive-control circuitry simultaneously powers the three coils.

Permanent magnet motors have been commercially available since the 1990's. However, permanent magnet motors have not seen wide spread use because of the high cost associated with the expensive permanent magnets on the rotor. Additionally, their complex control algorithms requires specialized engineering expertise as well as the additional expense of an embedded processor. Permanent magnet motors are more efficient than the AC-induction motors. However, because of the recent rise in the price of copper, the current winding-based induction motors have become more costly and the permanent magnet motors have become comparatively less expensive. Additionally, recent advances in technology have improved the power output of permanent magnet motors to where such motors have a superior power density to that of existing induction motors.

As such, the permanent magnet direct drive top drive system 40, as illustrated in FIG. 3, provides a superior power output for the direct drive of the drill stem and associated drill string.

Figure 4:
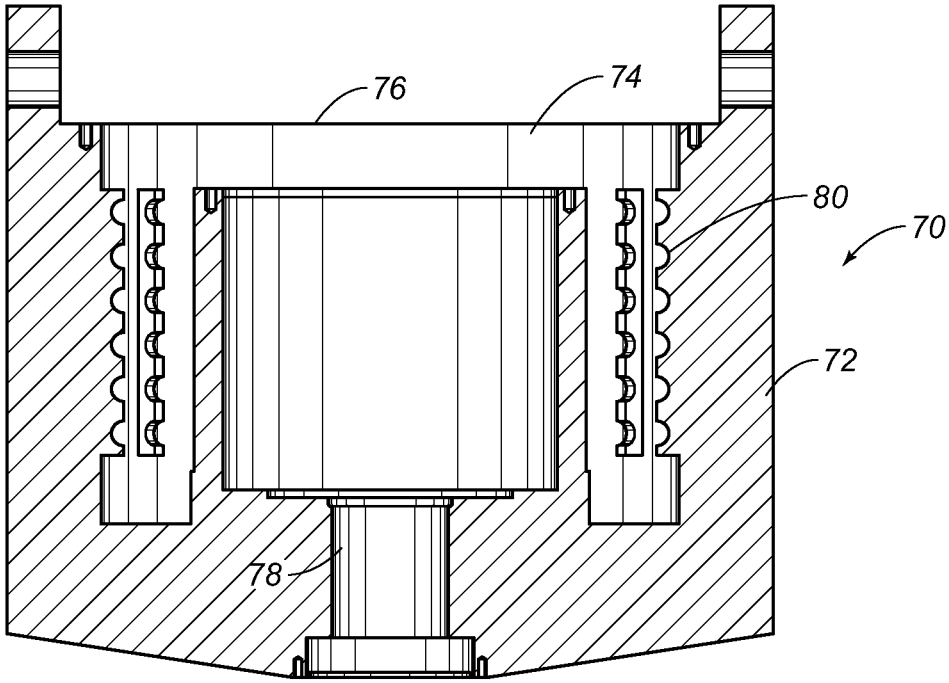
FIG. 4 is a diagrammatic illustration of the interior of the direct drive top drive of the present invention.

FIG. 4 shows an interior view of another housing for the direct drive top drive system 70 of the present invention. As can be seen, the housing 72 defines an interior chamber 74. A drive plate 76 is mounted to the rotor. A channel 78 is located at the bottom of chamber 74 so as to allow the drill stem 68 to be inserted therein. Suitable shoulders and other mechanisms assure the proper positioning of the drill stem in relation to the chamber 74. Cooling pathways 80 are associated with the coils of the stator and allow for the passage of cooling air so as to circulate along the stator coils.

Figure 5:
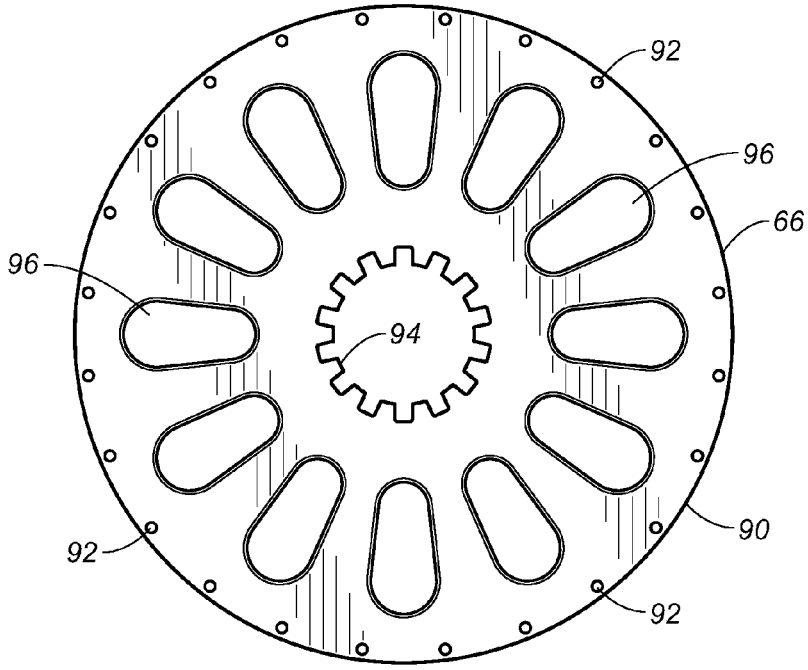
FIG. 5 is a plan view showing the drive plate associated with the permanent magnet direct drive top drive of the present invention.

FIG. 5 illustrates the drive plate 66 as used in the present invention. The drive plate 66 has a circular shape with an outer periphery 90. Bolt holes 92 are formed adjacent to the outer periphery 90. These bolt holes allow for the bolted attachment of the drive plate 66 to the top of the rotor. A splined aperture 94 is formed centrally of the drive plate 66 so as to accommodate the splines associated with the drill stem. Air circulation holes 96 are formed around the interior of the drive plate 66 so as to facilitate air circulation within the permanent magnet direct drive top drive system of the present invention.

Figure 6:
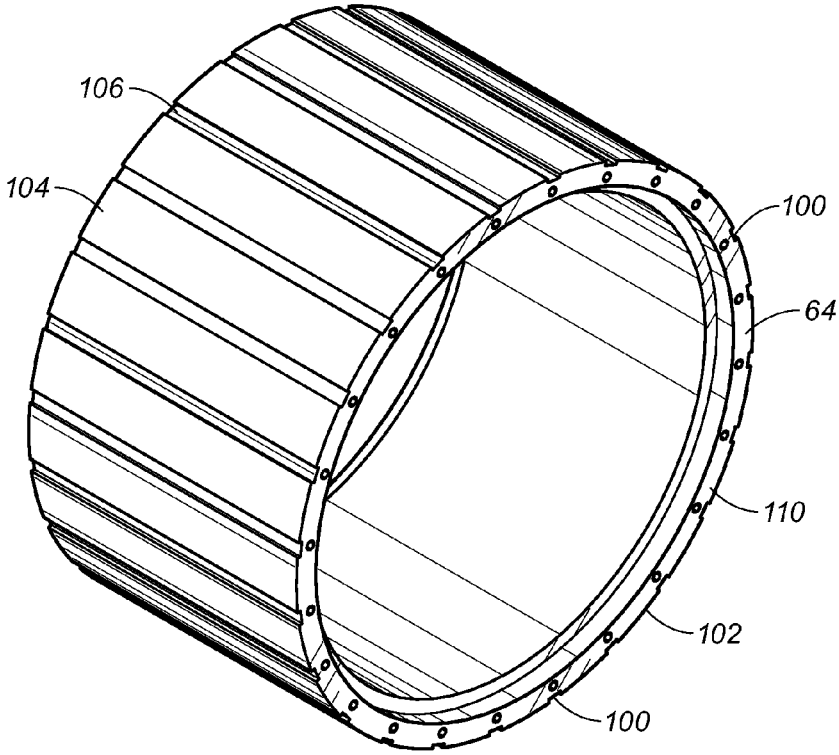
FIG. 6 is a perspective view of permanent magnet rotor of the direct drive top drive system of the present invention.

FIG. 6 illustrates the rotor 64 of the direct drive top drive system of the present invention. Rotor 64 includes holes 100 formed adjacent to the periphery 102 of the rotor 64. These holes 100 can receive bolts that are associated with the bolt holes 92 of the drive plate 66. As such, the drive plate 66 can be mounted directly onto the top of the rotor 64. Permanent magnet piles 104 are affixed to the outer surface of the rotor 64 in spaced relationship to each other. Spacers 106 serve to isolate one of the permanent magnet piles from an adjacent pile. Spacers can be separate items or they can be simply a formed surface on the outer periphery 102 of the rotor 64. The rotor 64 has a rotor bearing bore 110 formed centrally thereof.

Figure 7:
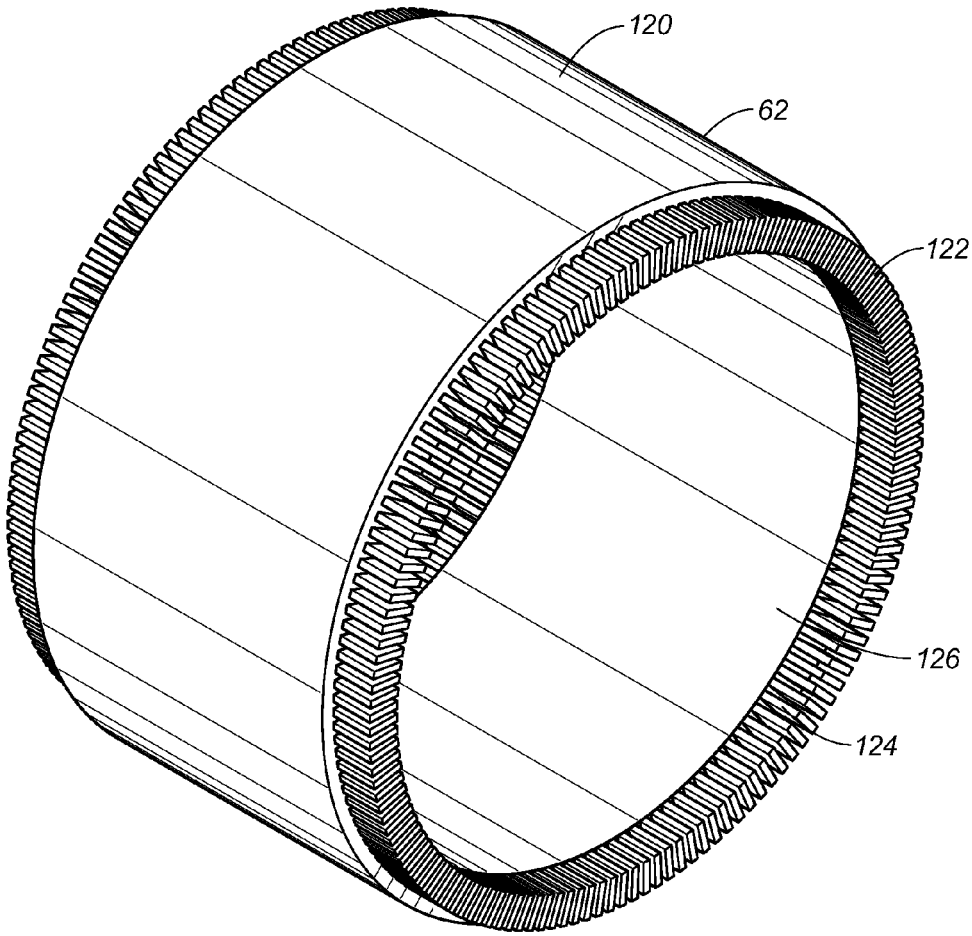
FIG. 7 is a perspective view showing the stator as used in the direct drive top drive of the present invention.

FIG. 7 shows the stator 62 associated with the permanent magnet direct drive top drive system of the present invention. Stator 62 has an outer cover 120 which serves to space the coils 122 from the inner wall of the housing 42 of the permanent magnet direct drive top drive system 40 of the present invention. The coils 122 extend radially inwardly therefrom. The interior surface 124 of the coils 122 define a circular appature into which the rotor 64 is placed. As a result, the permanent magnet piles 104 will be in close proximity to the coils 122 so that the permanent magnet system can operate properly. Suitable electronics can be connected to the permanent magnet direct drive top drive system 40 so as to facilitate the proper operation of the permanent magnet system.

In the present invention, it will be appreciated that the permanent magnet direct drive top drive is directly connected to the drill stem. As such, there are no gears or other transmission mechanisms that are interconnected in these areas. As such, the present invention provides an enhanced power density for the proper rotation of the drill string in a relatively light weight configuration. The weight associated with transmission systems is effectively avoided by the present invention. Furthermore, the complexity of installing such transmission systems so that the power of the induction motor can be transmitted to the drive system is avoided in the present invention. As a result, the permanent magnet direct drive top drive of the present invention can serve the proper purpose of rotating the drill string with a minimal weight. Unlike the present motors associated with drilling operations that can weigh in excess of 100,000 pounds, the permanent magnet motor of the present invention will only weigh approximately 60,000 pounds. As such, it can be easily transported on a conventional truck over roads. Unlike the prior art, the motor does not have to be assembled in itself or with the transmission system in the field. As such, the present invention avoids the specialized requirement of installation personnel that would be otherwise required for those systems that require transmissions between the motor and the drill string. The reduced weight of the permanent magnet motor of the present invention avoids certain inertial effects that would otherwise adversely affect the operation of conventional induction motors. The motor of the present invention can be interchanged, as desired, for use in association with the drawworks of the drilling rig or the mud pump of the drilling rig. Since transmission systems are not required, a supply of such permanent magnet motors can be provided to the drilling operation for use either in association with a top drive or for other purposes. If there would be a failure of any one motor, then any of the other motors could be substituted therefore without any downtime on the drilling rig.

The foregoing disclosure and description of the invention is illustrative and explanatory thereof. Various changes in the details of the described apparatus may be made without departing from the true spirit of the present invention. The present invention should only be limited by the following claims and their legal equivalents.

I claim:

1. A drive system for a drilling rig comprising:

a housing having an interior chamber;

a stator positioned in said interior chamber of said housing, said stator having a plurality of windings extending in spaced relation around an interior diameter of said stator; and a rotor positioned in said interior of said stator and within said interior chamber of said housing, said rotor having a plurality of permanent magnets in spaced relation around a periphery of said rotor, said rotor having means connected thereto for directly coupling said rotor to a stem of a drill string of the drilling rig.

2. The drive system of claim 1, said plurality of windings extending radially inwardly of said stator.

3. The drive system of claim 1, said stator having a plurality of air flow passageways formed therein.

4. The drive system of claim 1, said rotor being an annular member, said plurality of permanent magnets being cooperative with said plurality of windings such that a rotational motion is imparted to said rotor.

5. The drive system of claim 1 further comprising:

a drive plate affixed to said rotor.

6. The drive system of claim 5, said drive plate having a splined interior passageway, the stem having a plurality of splines engageable with said splined interior passageway of said drive plate.

7. The drive system of claim 1, said means for directly coupling said rotor to the stem of the drill string being without a transmission such that a rotational motion of said rotor is directly imparted onto the drill string.

8. The drilling system of claim 7, said means for directly coupling said rotor to the drilling system being without a transmission such that a rotational motion of the rotor is directly imparted onto the drill string.

9. A drilling system comprising:

a drilling rig having a rig floor;

a drill string extending through said rig floor; and a top drive system directly coupled to an end of said drill string and supported by said drill rig above said rig floor, said top drive system comprising:

a housing having an interior chamber;

a stator positioned in said interior chamber of said housing, said stator having a plurality of windings extending in spaced relation around an inner diameter of said stator; and a rotor positioned in an interior of said stator and within said interior chamber of said housing, said rotor having a plurality of permanent magnets in spaced relation around a periphery of said rotor, said rotor having means thereon for directly coupling said rotor to the drill string.

10. The drilling system of claim 9, said plurality of windings extending radially inwardly of said stator.

11. The drilling system of claim 9, said stator having a plurality of air flow passageways formed therein.

12. The drilling system of claim 9, said rotor being an annular member, said plurality of permanent magnets being cooperative with said plurality of windings such that a rotational motion is imparted to said rotor.

13. The drilling system of claim 9, said means of said rotor comprising: a drive plate affixed to said rotor.

14. The drilling system of claim 13, said drive plate having a splined interior passageway, said drill string having a stem with a plurality of splines engaged with said splined interior passageway of said drive plate.

15. A drive system for a drilling rig comprising:

a housing having an interior chamber;

a stator positioned in said interior chamber of said housing;

a rotor positioned in said interior of said stator and within said interior chamber of said housing, said rotor having a plurality of permanent magnets in spaced relation around a periphery of said rotor; and a drive plate affixed to said rotor, said drive plate having an interior passageway suitable for joining to a stem of a drill sting.

16. The drive system of claim 15, said drive plate having a splined interior passageway suitable for engaging splines of the stem of the drill string.

17. The drive system of claim 15, said stator having a plurality of windings extending in spaced relation around an inner diameter of said stator, said plurality of windings extending radially inwardly of said stator, said rotor being an annular member, said plurality of permanent magnets being cooperative with said plurality of windings such that a rotational motion is imparted to the rotor.

18. The drive system of claim 15, said stator having a plurality of air flow passageways formed therein.

* * * * *

UNITED STATES PATENT AND TRADEMARK OFFICE
Certificate

Patent No. 8,567,529 B2 Patented: October 29, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kevin R. Williams, Cypress, TX (US); and Charles Patrick, Houston, TX (US).

Signed and Sealed this Fifteenth Day of July 2014.

DAVID J. BAGNELL
*Supervisory Patent Examiner*
Art Unit 3672
Technology Center 3600